US007250844B2

(12) United States Patent
Arai et al.

(10) Patent No.: US 7,250,844 B2
(45) Date of Patent: Jul. 31, 2007

(54) STICK LEVER UNIT FOR RADIO CONTROLLED DEVICE AND RADIO CONTROLLED DEVICE EQUIPPED WITH THE SAME

(75) Inventors: Masahiro Arai, Mobara (JP); Masashi Tokita, Mobara (JP); Takahiro Isono, Mobara (JP)

(73) Assignee: Futaba Corporation, Chiba-ken (JP)

( * ) Notice: Subject to any disclaimer, the term of this patent is extended or adjusted under 35 U.S.C. 154(b) by 106 days.

(21) Appl. No.: 11/238,594

(22) Filed: Sep. 29, 2005

(65) Prior Publication Data

US 2006/0073762 A1 Apr. 6, 2006

(30) Foreign Application Priority Data

Oct. 1, 1920 (JP) ..... 2004-290798

(51) Int. Cl.
*H01C 10/30* (2006.01)

(52) U.S. Cl. ..... 338/118; 338/162; 345/156; 341/34

(58) Field of Classification Search ..... 338/68, 338/72, 74, 110, 118, 160–162, 172; 345/156, 345/161, 164, 160, 168; 341/34; 200/6 A
See application file for complete search history.

(56) References Cited

U.S. PATENT DOCUMENTS

| | | | | |
|---|---|---|---|---|
| 4,469,330 | A * | 9/1984 | Asher | 463/38 |
| 5,229,742 | A * | 7/1993 | Miyamoto et al. | 338/128 |
| 5,491,462 | A * | 2/1996 | Cecchi et al. | 338/128 |
| 5,520,644 | A * | 5/1996 | Imran | 604/528 |
| 6,573,885 | B1 * | 6/2003 | McVicar | 345/161 |
| 2003/0137394 | A1 * | 7/2003 | Romero Herrera et al. | 338/32 H |

FOREIGN PATENT DOCUMENTS

| | | |
|---|---|---|
| JP | 62-87697 | 6/1987 |

* cited by examiner

*Primary Examiner*—Kyung Lee
(74) *Attorney, Agent, or Firm*—Quarles & Brady LLP

(57) ABSTRACT

A stick lever unit for a radio-controlled device that is capable of easily changing the type of stick lever holding mechanism by a user is provided. The stick lever unit includes a fixing member to which a variable resistor is attached, a rotational member equipped with a stick lever, the rotational member being journaled to the fixing member and having an arc-shaped groove on a periphery thereof, and a pressure member bridged to the fixing member for pressing the arc-shaped groove. The pressure member has resilient plates of two types which can be suitably selected by means of an adjustment member.

9 Claims, 9 Drawing Sheets

STICK LEVER UNIT FOR RADIO CONTROLLED DEVICE AND RADIO CONTROLLED DEVICE EQUIPPED WITH THE SAME

CROSS REFERENCES TO RELATED APPLICATIONS

This application claims the priority benefit of Japanese Patent Application No. 2004-290798 filed on Oct. 1, 2004.

STATEMENT REGARDING FEDERALLY SPONSORED RESEARCH

Not Applicable.

BACKGROUND OF THE INVENTION

The present invention relates to stick lever units for radio-controlled devices, which remotely maneuver controllable bodies, such as model airplanes, model helicopters, and cars, or boats, by controlling a stick lever. More particularly, the present invention relates to radio-controlled devices, having the stick lever unit.

A stick lever unit for radio control (hereinafter, referred to as a stick lever unit) is equipped on radio-controlled devices (radio-control devices for models), each of which remotely controls manipulated bodies, such as model airplanes, model helicopters, model cars, and model boats (refer to Japanese Utility Model Publication No. 62-87697).

The stick lever unit is shown in FIG. 9. In the conventional radio control unit 1, two sets of right and left stick lever units 2 are respectively equipped horizontally on the upper portion of the front surface thereof. The stick lever of each stick lever unit 2 is operated vertically and horizontally. The stick lever unit 2 is manipulated to control proportional control signals carried with radio waves transmitted to a controllable body from the radio-controlled device. Thus, the stick lever unit 2 controls operational movements of various servomechanisms mounted on the controllable body to remotely control the controllable body.

Such stick lever units include a stick lever returning mechanism that automatically returns the stick lever to a predetermined neutral position when the operator takes off the stick lever in an operation state of the stick lever in a certain operation direction or a stick lever holding mechanism that maintains the stick lever at its position even when the operator takes off his fingers in the stick lever operational state. For example, the stick lever return mechanism is equipped in the operational direction of the stick lever, which controls the aileron, rudder and the elevator, which control the flight direction of an airplane. Moreover, instead of installation of the return mechanism, the stick lever holding mechanism that maintains the control volume, even when an operator takes off his fingers from the stick lever, to maintain the number of revolutions of the engine in a constant value during flight, for example, is equipped in the operation direction of the stick lever, which controls the output of the model engine of the model airplane.

The stick lever unit including the stick lever return mechanism and the stick lever holding mechanism will be described specifically here by referring to the drawings. FIGS. 10 and 11 illustrate a conventional stick lever unit. FIG. 10 is a plan view illustrating the conventional stick lever unit. FIG. 11 is the rear view illustrating the conventional stick lever unit. First, the basic configuration of the stick lever unit will be explained below.

The stick lever unit 2 includes a fixing frame 21 acting as a fixing member, a rotational frame 22 and a rotational control element 23, acting as rotational members, and a stick lever 24 mounted on the rotational control element 23. A substantially rectangular window 21*a* penetrates in the center of the fixing frame 21. The rotational frame 22, being a semi-cylindrical member, is journaled rotatably on the rotational shaft 25*a* (acting as one rotational shaft) of the variable resistor 25 attached to the fixing frame 21 and the rotational shaft 22*a* (acting as the other rotational shaft) thereof attached to the rotational frame 22.

A small rectangular window 22*b* is formed in the center of the rotational frame 22. The rotational control element 23 attached to the stick frame 24 is rotatably fit loosely within the small window 22*b*. The rotational shaft of the rotational control element 23 is made of the rotational shaft 26*a* of the variable resistor 26 fixed to the rotational frame 22. One end of the rotational shaft 26*a* is journaled in the rotational frame 22. In this configuration, when an operator manipulates the stick lever 24 vertically, horizontally, and slantingly, the rotational frame 22 and the rotational control element 23 rotate and the variable resistors 25 and 26 rotate, so that the output signals to the manipulated object are controlled.

Next, the configurations of the return mechanism and the holding mechanism of the stick lever 24 in the stick lever unit 2 will be described blow.

As shown in drawings, in the return mechanism of the stick lever 24, two contact pins 27 and 27 are disposed to the rotational control element 23. An arm 28 and a spring 29 are disposed to the rotational frame 22. The arm 28 has one end 28*a* rotationally attached to the rotational frame 22 and the other end 28*b* attached to the spring 29. Thus, the arm 28 acts to always depress against the contact pins 27, 27. Accordingly, when the stick lever 24 rotates the rotational control element 23, one of the contact pins 27 is pressed to the arm 28. When the stick lever 24 is released, the rotational control element 23 automatically returns to the predetermined original position.

In addition, in the configuration of the holding mechanism of the stick lever 24, an arc-shaped groove 22*c* is formed in the rotational frame 22. The groove 22 is in a fan-shaped form with respect to the rotational shaft 22*a* acting as the center and has an outer circumference with gear-shaped groove therein. A resilient plate 30 acting as a pressure member is attached to the fixing frame 21. When the resilient plate 30 presses the arc-shaped groove 22*c*, a resistance force occurs against the rotational operation of the rotational frame 22. As a result, the stick lever 24 is held at the position where it has been rotated.

In the stick lever holding mechanism, because the one end of the resilient plate 30 is fastened on the fixing frame 21 with a screw, the spaced distance between the resilient plate 30 and the fixing frame 22 can be adjusted. By turning the adjustment screw, that configuration allows the pressure force of the pressure member working on the arc-shaped groove 22*c* as a stick lever holding mechanism to be freely adjusted. (Refer to Japanese Utility Model Publication No. 62-87697)

In such a stick lever unit, a different type of resilient plate (pressure member) configuring a stick lever holding mechanism is used according to the object manipulated by a radio-controlled device. For example, in the stick lever unit for manipulating a model airplane, a ratchet-type resilient plate having a protrusion in the resilient slate which is engaged with the arc-shaped groove to hold stepwise operation positions of the stick lever may be used. In model helicopters, a brake-type resilient plate having a flat resilient plate without protrusion, which can steplessly hold the operation positions of the stick lever by engaging the resilient plate to the arc-shaped groove may be used.

Conventionally, the manufacturer specified the resilient plate for radio-controlled devices attached to the stick lever unit and mounted the stick lever unit to the radio-controlled device for shipping as a complete device. For that reason, when a user wants to change the resilient plate after purchase of the product, the installed resilient plate is removed after opening the housing of the radio-controlled device body to replace it for other type of resilient plate. This work has been troublesome.

Further, when a resilient plate to be replaced is not at hand or the user himself cannot replace the resilient plate, the product has to be sent to the manufacturer to ask for the replacement of the resilient plate. This is troublesome and takes much time which is very inconvenient.

SUMMARY OF THE INVENTION

The present invention is made to solve the above-mentioned problems.

An object of the present invention is to provide a stick lever unit, in which a user can easily change a resilient plate in the stick lever unit, without replacement of the resilient plate.

Another object of the present invention is to provide a radio-controlled device having a stick lever unit, in which a user can easily change the resilient plate in the stick lever unit, without opening the housing of the radio-controlled device.

In order to achieve the above mentioned objects, a stick lever unit for radio controlled device, according to the present invention, comprises a fixing member to which a variable resistor is attached; a rotational member, equipped with a stick lever, connected to a rotational portion of the variable resistor and rotationally journaled to the fixing member, the rotational member having an outer circumference, which has an arc-shaped groove in which gear-shaped grooves are formed; a pressure member, bridged to the fixing member, for holding the rotational member at an arbitrary rotational position, when the arc-shaped groove is pressed with the resilient force of the pressure member; and an adjustment member for positioning and fixing the pressure member to the fixing member and for adjusting a distance of the pressure member spaced to the fixing member; the pressure member having at least two types of resilient plates of which a portion in contact with the arc-shaped groove is deformed, whereby, at least one of the resilient plates can be selected by means of the adjustment member for applying the resilient force of the pressure member.

In the stick lever unit of the present invention, one end of each resilient plate is coupled to the fixing member and the other ends are fixed respectively to the fixing member via the adjustment member.

In the stick lever unit of the present invention, each of the resilient plates is positioned to the fixing member by means of the adjustment member via a buffer.

In another aspect of the present invention, a radio-controlled device is equipped with the stick lever unit for radio control described above.

In the radio-controlled device of the present invention, an adjustment opening for adjusting the adjustment member at a position opposed horizontally to the adjustment member is provided in a back surface of a housing defining the outline of said radio control device.

In the radio-controlled device of the present invention, the adjustment opening has an outer circumference extending a predetermined length toward the inside of the housing.

In the stick lever unit for a radio-controlled device according to the present invention, two types of resilient plates, each in different shape, are provided as a pressure member configuring a stick lever holding mechanism. By adjusting the distance of a resilient plate spaced from the fixing member with the adjustment member, a user can suitably select a desired resilient plate. For that reason, there is the advantage in that a user can easily change the resilient plate in the stick lever unit, without replacing the resilient plate.

The adjustment screw can be directly adjusted from the outside of the radio-controlled device equipped with the stick lever unit, by means of a screwdriver or wrench. Therefore, there is the advantage in that adjustment can be easily performed without opening the housing of the radio-controlled device.

BRIEF DESCRIPTION OF THE DRAWINGS

This and other objects, features, and advantages of the present invention will become more apparent upon reading of the following detailed description and drawings, in which.

DESCRIPTION OF THE EMBODIMENTS

The best mode for embodying the present invention will be described below by referring to the Figures.

Figure 10:
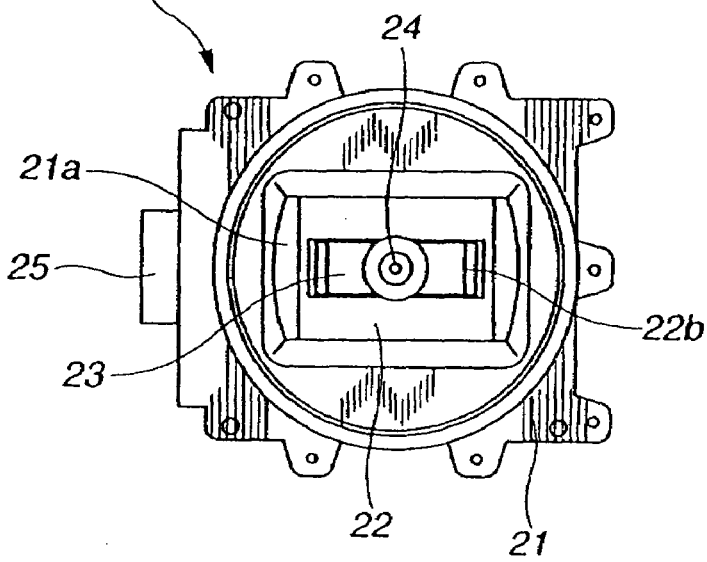
FIG.10 (PRIOR ART)
FIG. 10 is a front view illustrating a conventional stick lever unit.
Figure 11:
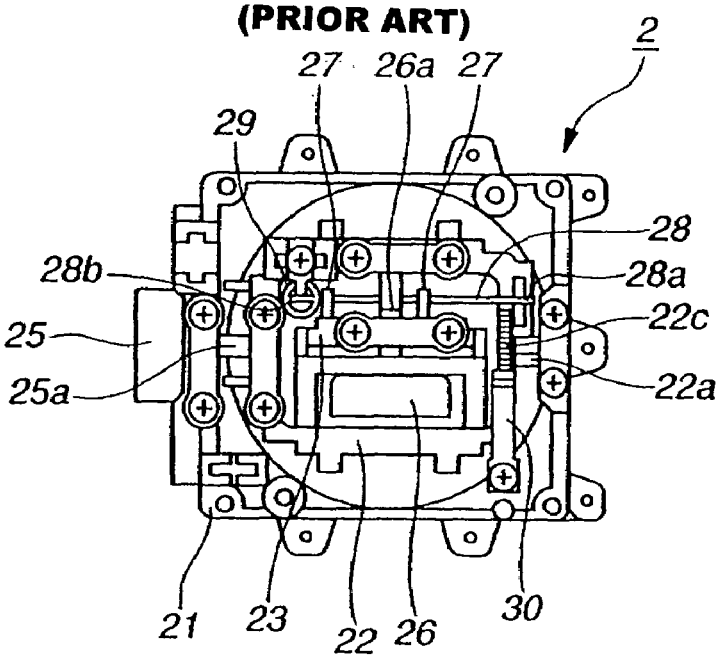
FIG.11 (PRIOR ART)
FIG. 11 is a rear view illustrating the conventional stick lever unit shown in FIG. 10.

A stick lever unit for a radio-controlled device (hereinafter, a stick lever unit), according to the present invention has substantially the basic configuration similar to that shown in FIGS. 10 and 11 described in the background art. However, specific shapes of respective constituent elements are different from those of that shown in FIGS. 10 and 11. Accordingly, the portions related to the stick lever holding mechanism, being a main portion of the present invention, will be explained below. Like reference numerals are used to designate to the portions corresponding to those in FIGS. 10 and 11 so that the duplicate explanation is omitted.

As shown in FIGS. 1 to 4, the rotational frame (rotational member) 22 of the stick lever unit 2 according to the present invention has an arc-shaped groove 22*c* forming a mechanism for holding the stick lever 24. The arc-shaped groove 22*c* is in a fan- shape with respect to a rotational shaft 22*a* and has a gear-shaped groove around the outer circumference of the rotational shaft 22*a*. In the arc-shaped groove 22*c*, the fringe portion extends outward the rotational frame 22 and is wider than the corresponding portion of the conventional stick lever unit.

Two columns 21*b* and 21*c* are set up on the fixing frame (fixing member) 21. A screw hole 21*d* is formed in one end of the column 21*b* and two screw holes 21*e* are formed in one end of the column 21*c*.

Resilient plates 30*a* and 30*b* of two types, each having a different shape and acting as a pressure member for pressing the arc-shaped groove 22*c* formed in the rotational frame 22, are bridged between the columns 21*b* and 21*c*. The resilient plate 30*a* functions as a pressure member when a model airplane is manipulated, and includes a convex portion bent on the side of the rotational frame 22 at the portion in contact with the arc-shaped like groove 22*c* of the rotational frame 22. On the other hand, the resilient plate 30*b* functions as a pressure member when a model helicopter is manipulated, and includes a flat portion at the portion in contact with the arc-shaped groove 22*c* of the rotational frame 22.

A shared fixing portion 30*c* is formed of one ends of the resilient plates 30*a* and 30*b* connected together. The mounting hole 30*d* is formed in the fixing portion 30*c* and the mounting holes 30*e* and 30*f* are respectively formed in the other ends of the resilient plates 30*a* and 30*b*. The fixing portion 30*c* is directly fixed by the fixing screw 31, with the mounting hole 30*d* aligned with the screw hole 21*d* drilled in the column 2*c*. The resilient plates 30*a* and 30*b* are fixed via the adjustment screws 32 and the buffers 33, respectively, with the mounting screws 30*e* and 30*f* aligned with the screw holes 21*d* drilled in the column 21*c*. The adjustment screw 32 acts as an adjustment member, which can adjust the distance spaced from the column 21*c*.

Each buffer member 33 is formed of a nearly rectangular parallelepiped resin member having one side with a cutaway 33*a*. A through hole 33*b* is formed perpendicularly to the direction of the cutaway 33*a*. The ends of the resilient plates 30*a* and 30*b* are sandwiched with the cutaways 33*a*. The through hole 33*b* is aligned with the mounting hole 30*e*, 30*b* in the resilient plate 30*a*, 30*b* and the screw hole 21*d*. Thus, the resilient plate 30*a*, 30*b* is screwed to the column 21*c* with the adjustment screw 32.

The buffer member 33 is mounted so as to avoid the direct contact between the resilient plate 30*a*, 30*b* and the adjustment screw 32. As a result, the buffer member 33 works to prevent an impact noise, which may occur when the stick lever 24 rotates the rotational frame 22. The buffer member 33 also maintains the distance between the resilient plate 30*a*, 30*b* and the column 21*c* to a value or more.

In the present embodiment, each resilient plate 30*a*, 30*b* is sandwiched on the side of the resilient plate 30*a*, 30*b*, with the buffer member 33 turned upside down, although it is not explicitly mentioned. Accordingly, the minimum distance between the resilient plate 30*a* and the column 21*c* and the minimum distance between the resilient plate 30*b* and the column 21*c* can be set differently with simple common members, without preparing other members.

In the configuration of the stick lever holding mechanism described above, the resilient plates 30*a* and 30*b* are positioned and fixed to the column 21*b* and 21*c* set up on the fixing frame 21. However, when the spacing between the resilient plate 30*a*, 30*b* and the column 21*c* is adjusted by means of the adjusting screw 32 for fixing the resilient plate 30*a*, 30*b*, the operator can suitably select a desired resilient plate (pressure member) acting as a stick lever holding mechanism. Also, the operator can adjust the pressure force in action.

Figure 1:
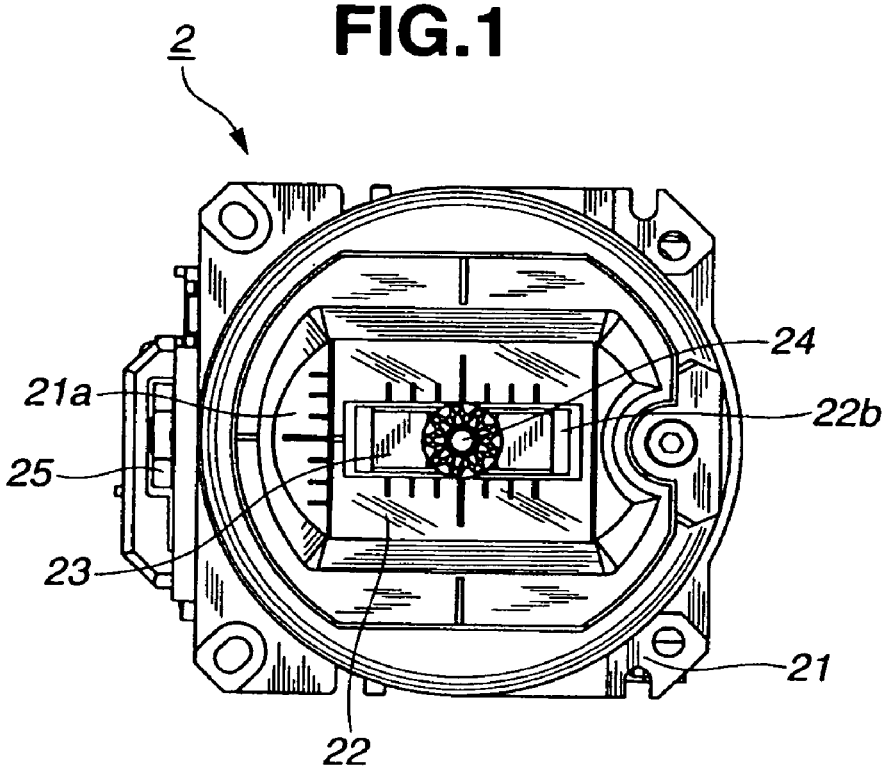
FIG. 1 is a front view illustrating a stick lever unit for a radio-controlled device, according to an embodiment of the present invention.
Figure 2:
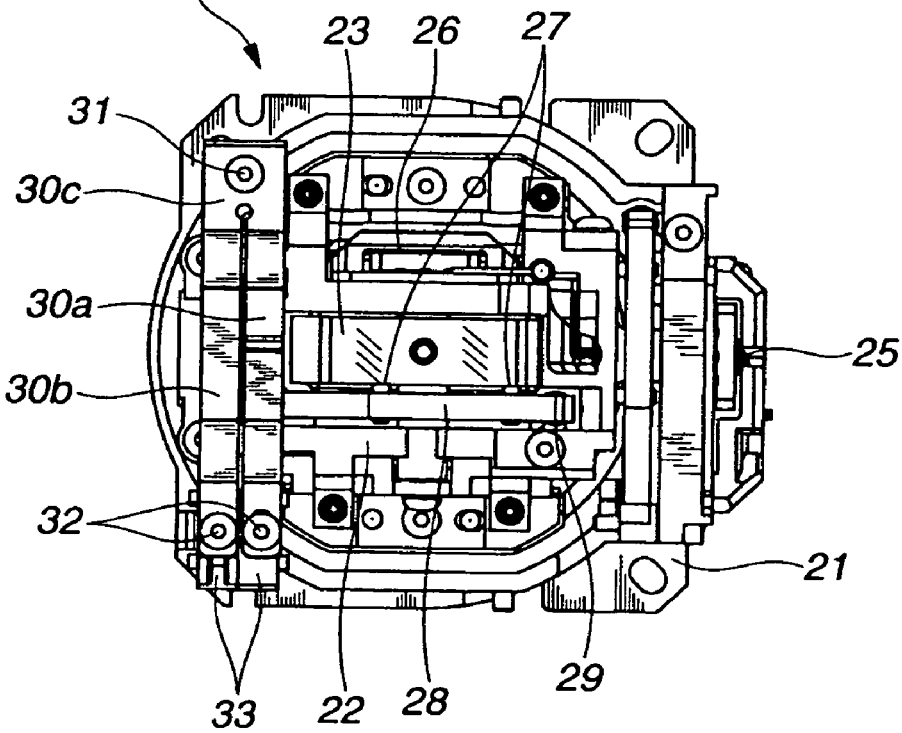
FIG. 2 is a rear view illustrating the stick lever unit for the radio-controlled device shown in FIG. 1.
Figure 3:
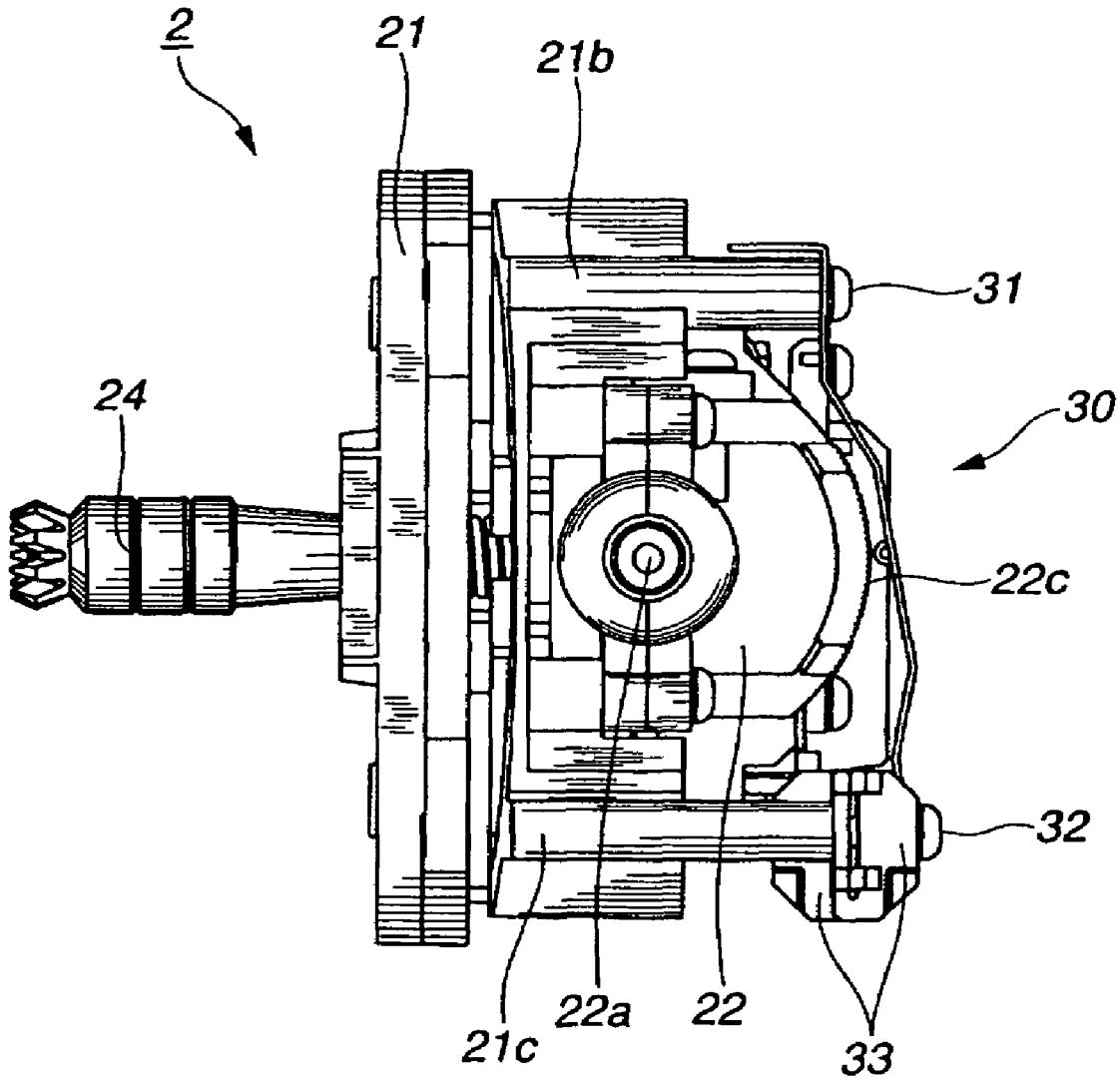
FIG. 3 is a right side view illustrating the stick lever unit for the radio-controlled device shown in FIG. 1.
Figure 4:
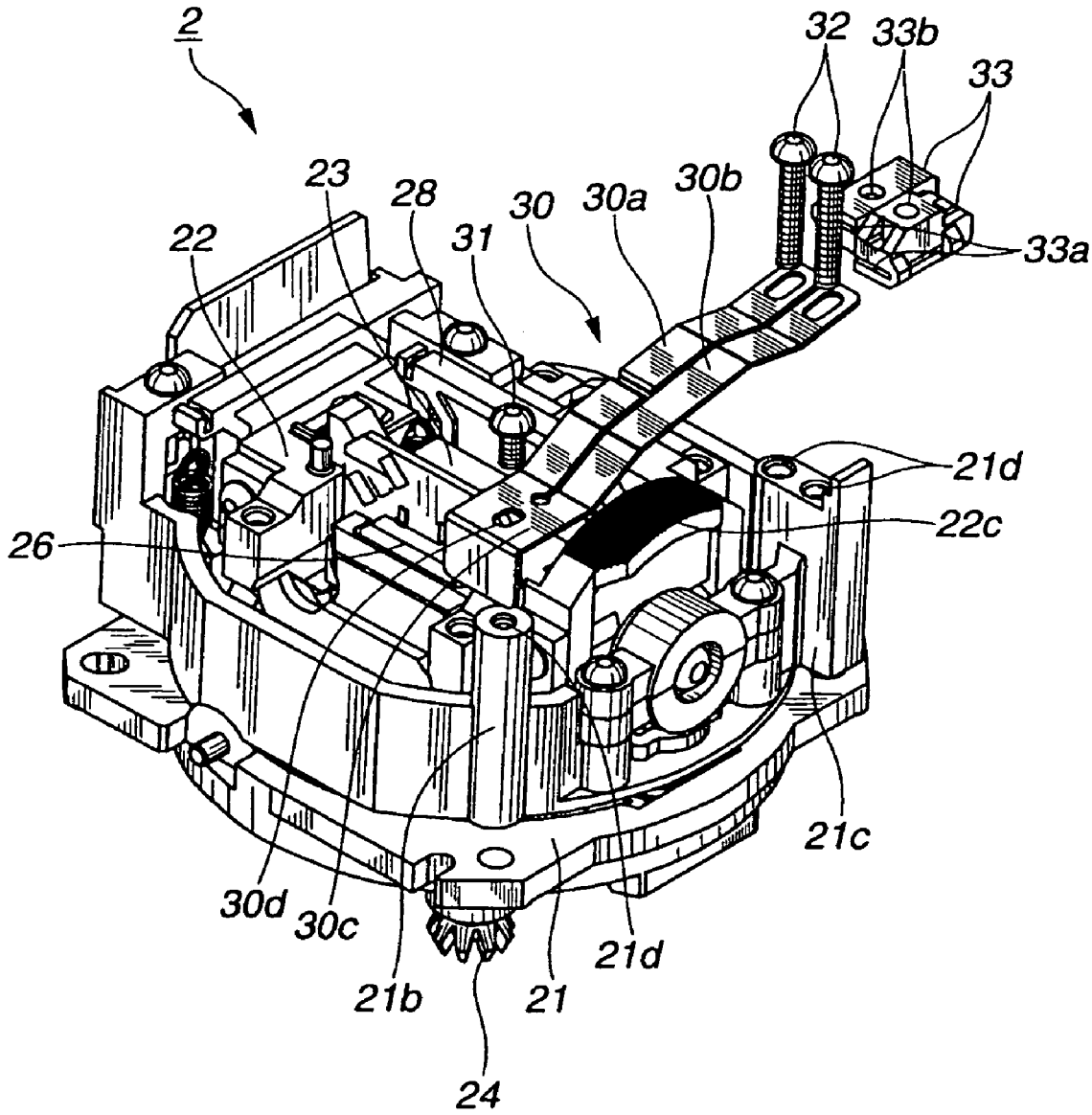
FIG. 4 is an exploded perspective view illustrating disassembled components of a stick lever holding mechanism in a stick lever unit for a radio-controlled device, according to the present invention.
Figure 5A:
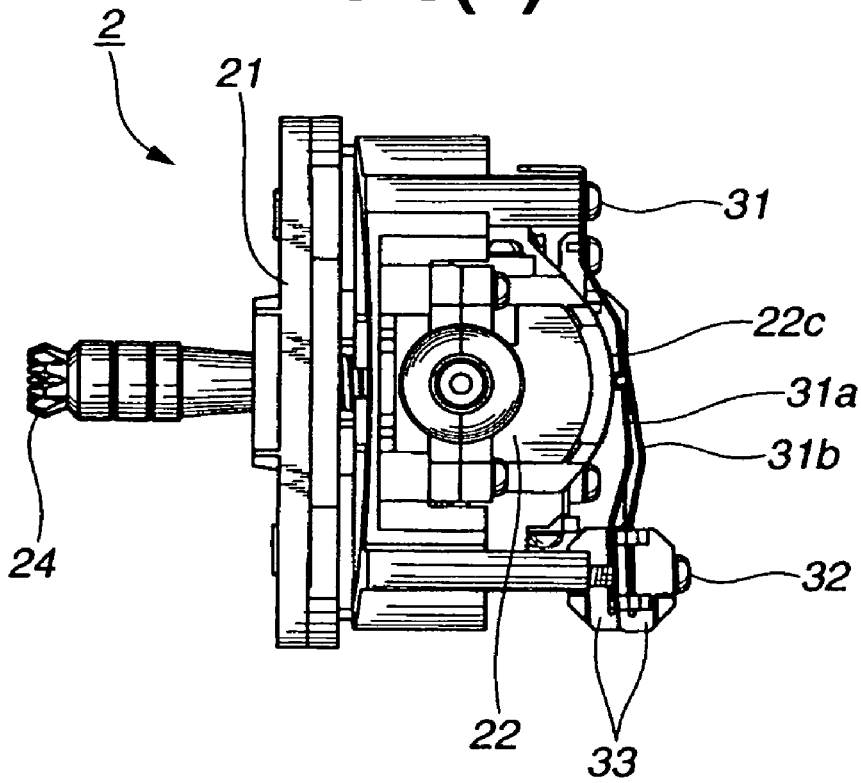
FIG. 5(*a*) is a right side view illustrating a stick lever unit when a model airplane is controlled and FIG. 5(*b*) is a right side view illustrating a stick lever unit when a model helicopter is controlled.
Figure 5B:
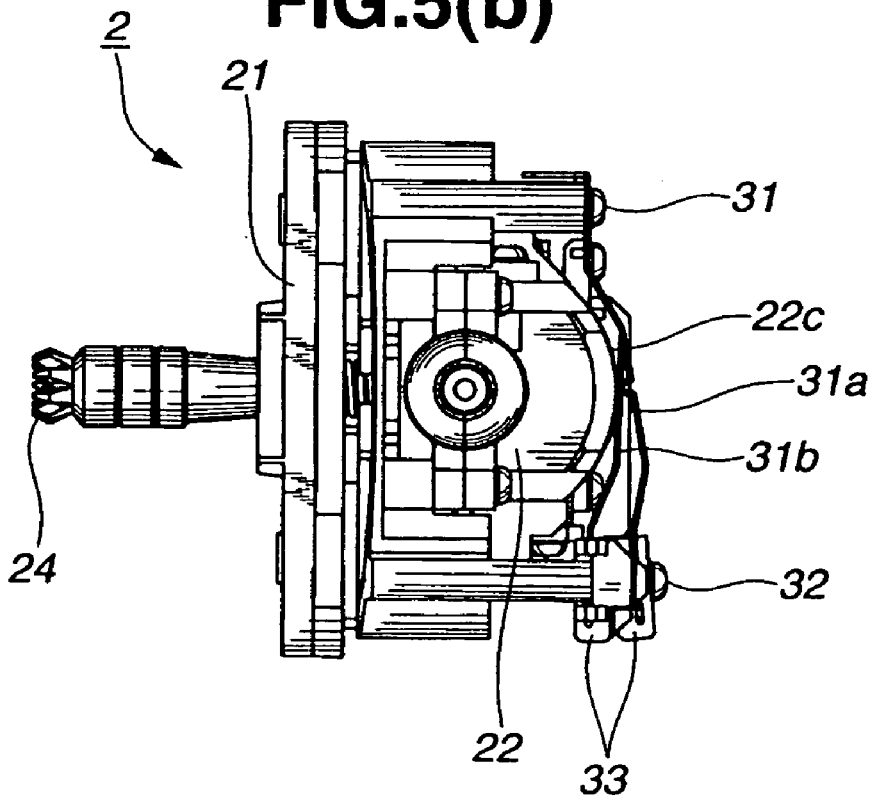

FIG. 5(*a*) shows the behavior of the stick lever unit when the resilient plate 30*a* is selected as a pressure member forming a stick lever holding mechanism in the normal control of a model airplane. FIG. 5(*b*) shows the behavior of the stick lever unit when the resilient plate 30*b* is selected as a pressure member forming a stick lever holding mechanism in the normal control of a model helicopter.

As shown in FIG. 5(*a*), when the resilient plate 30*a* is selected, the adjustment screw 32 for fixing the resilient plate 30*a* is tightened such that the convex portion of the resilient plate 30*a* engages and presses the arc-shaped groove 22*c*. The adjustment screw 32 for fixing the resilient plate 30*b* is loosened so as not to contact the resilient plate 30*b* with the arc-shaped groove 22*c*. Thus, the arc-shaped groove 22*c* is pressed by means of the resilient plate 30*a* only. When the stick lever 24 is rotates the rotational frame 22, the position of the rotational frame 22 is maintained stepwise.

In contrast, when the resilient plate 30*b* is selected, as shown in FIG. 5(*b*), the adjustment screw 32 for fixing the resilient plate 30*b* is loosened in such a way that the resilient plate 30*b* presses the arc-shaped groove 22*c*. Meanwhile, the adjustment screw 32 for fixing the resilient plate 30*a* is loosened in such a way that the resilient plate 30*a* to the resilient plate 30*a* is not contacted to the arc-shaped groove 22*c*. As a result, the arc-shaped groove 22*c* is pressed by the resilient plate 30*b* only. When the stick lever 24 rotates the rotational frame 302, the position of the rotational frame 22 is steplessly maintained.

As described above, the stick lever unit according to the present invention has two types of resilient plates, each having a different shape, as a pressure member forming a stick lever holding mechanism. When the adjustment member adjusts the spacing between each resilient plate and the fixing member, the operator can suitably adjust his desired resilient plate. Accordingly, when the user changes the resilient plate in the stick lever unit, the resilient plate can be easily changed without replacement of the resilient plate.

Next, a radio-controlled device equipped with the stick lever unit will be explained below by referring to the drawings.

For brief explanation, only the main portion of a radio-controlled device of the present invention, different from that in the conventional device, will be explained below.

Figure 6:
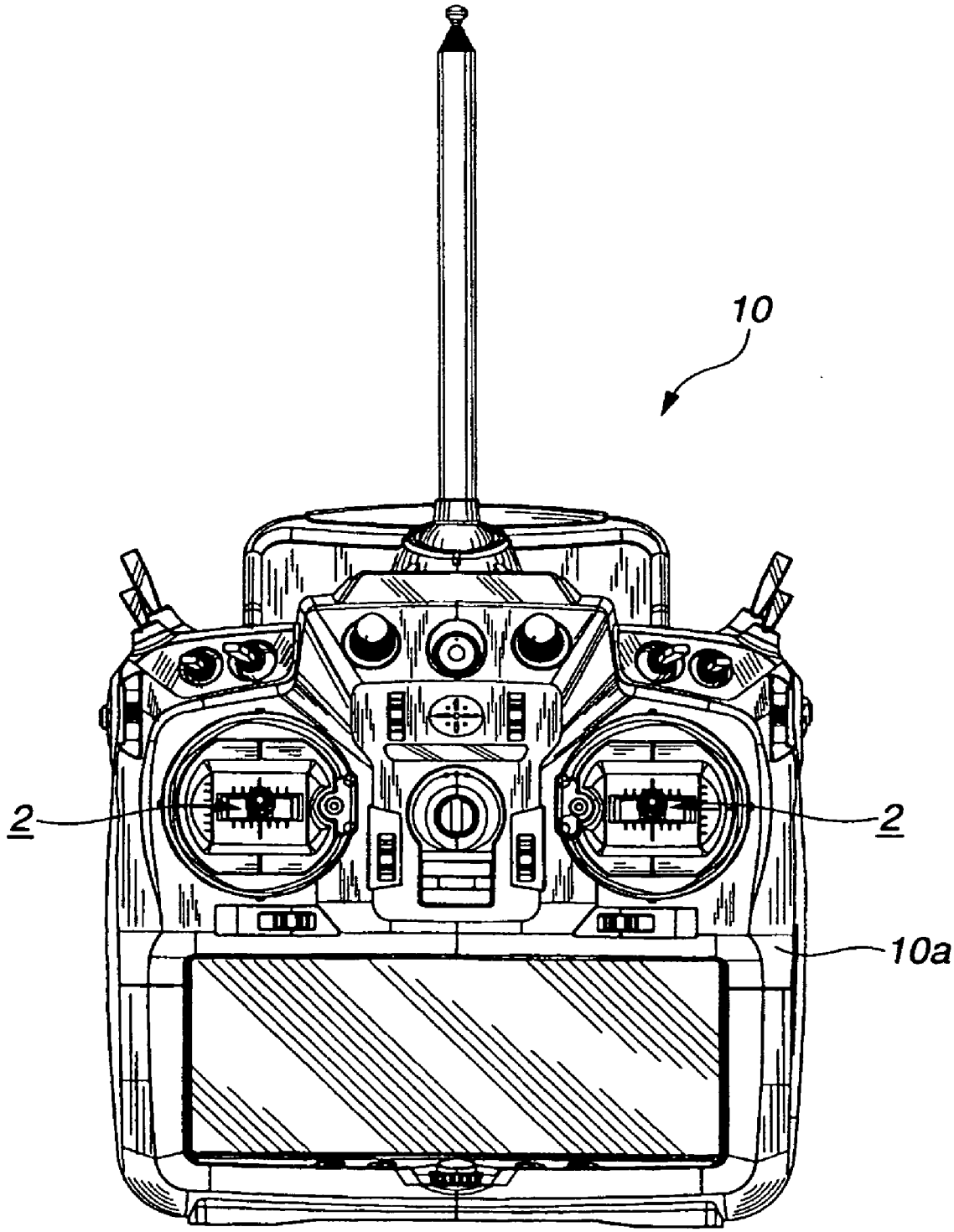
FIG. 6 is a front side view illustrating a radio-controlled device, according to an embodiment of the present invention.
Figure 7:
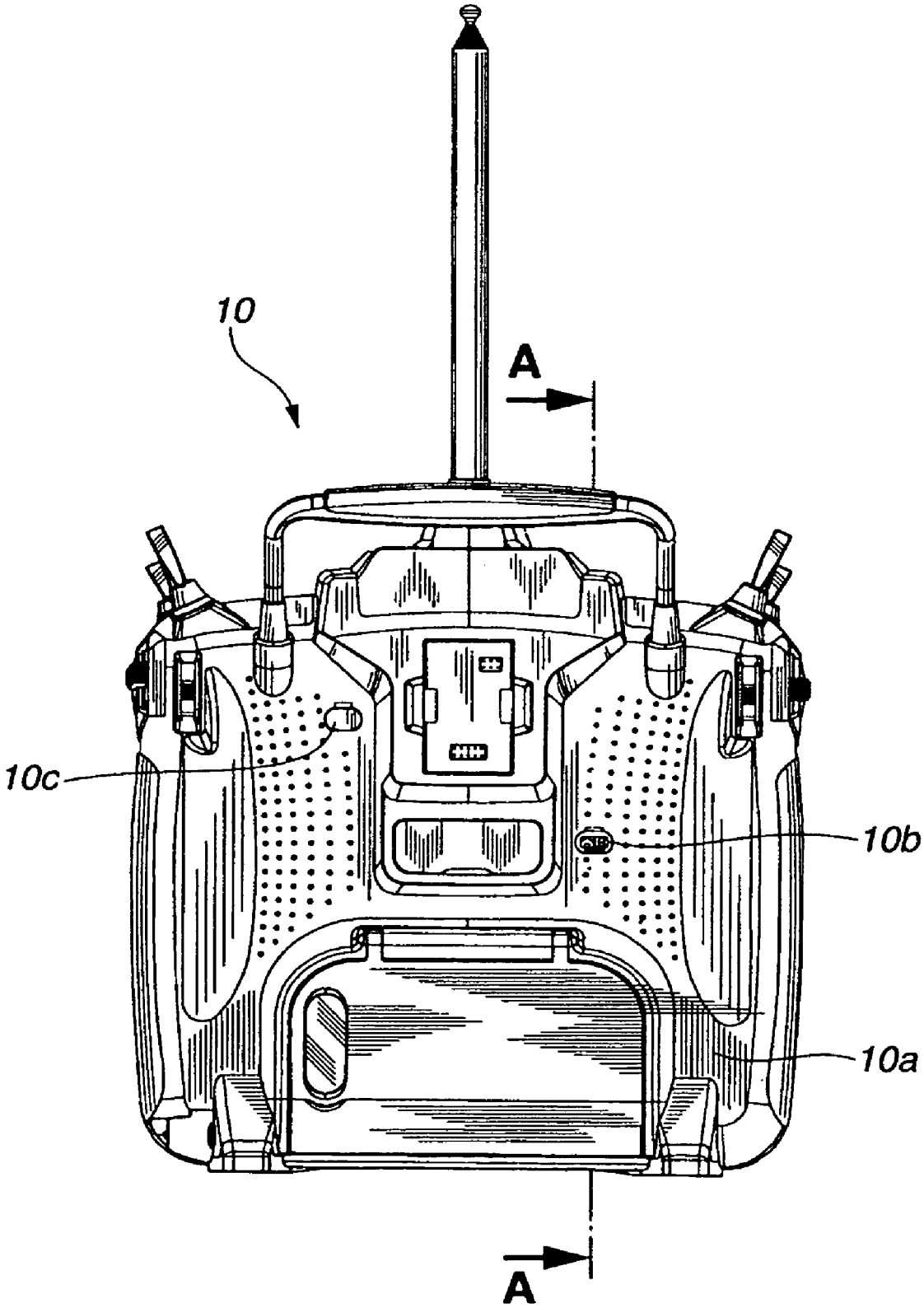
FIG. 7 is a rear side view illustrating the radio-controlled device shown in FIG. 6.
Figure 8:
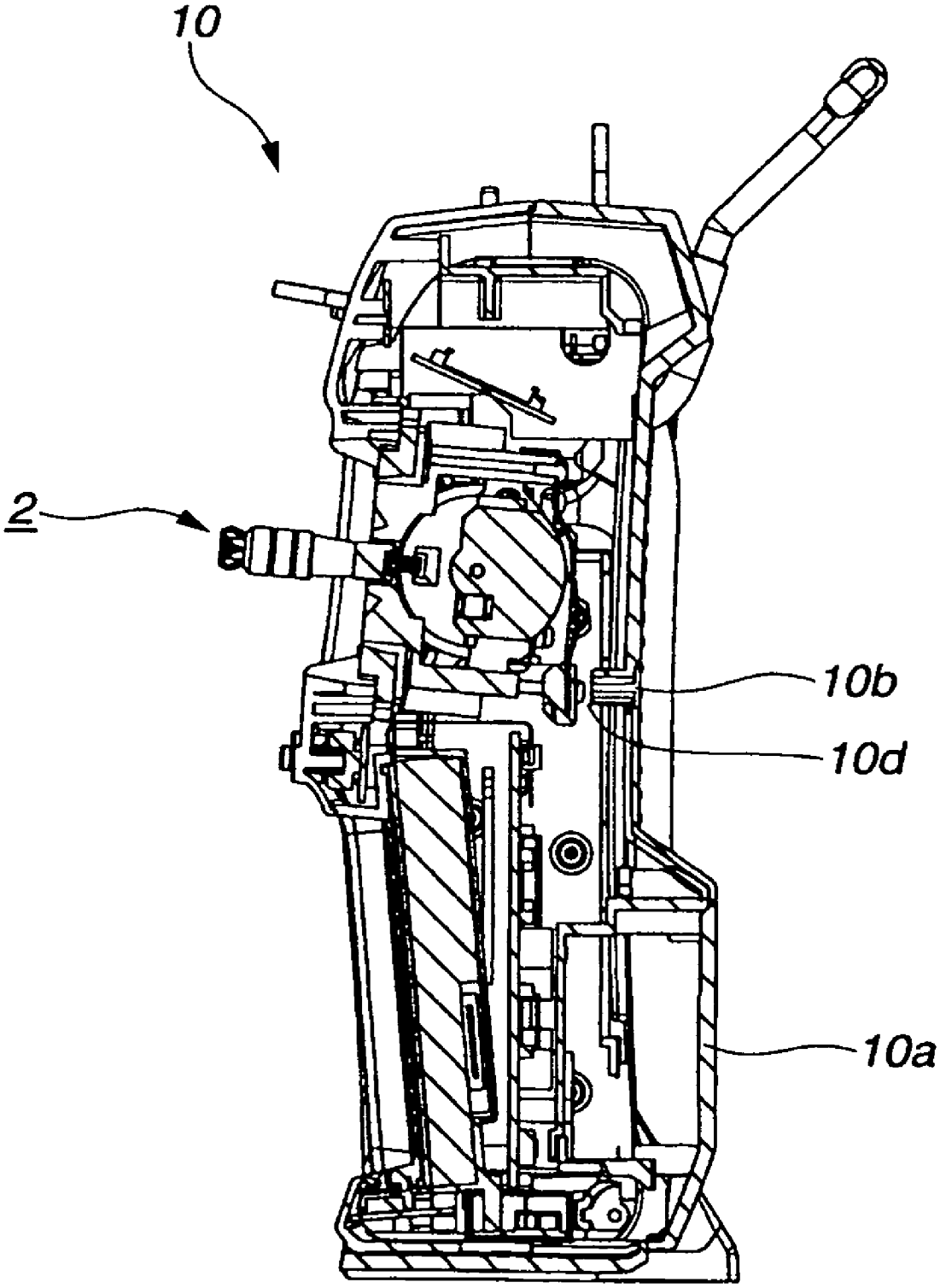
FIG. 8 is a cross-sectional view illustrating the radio-controlled device taken along cut the line A-A of FIG. 7.
Figure 9:
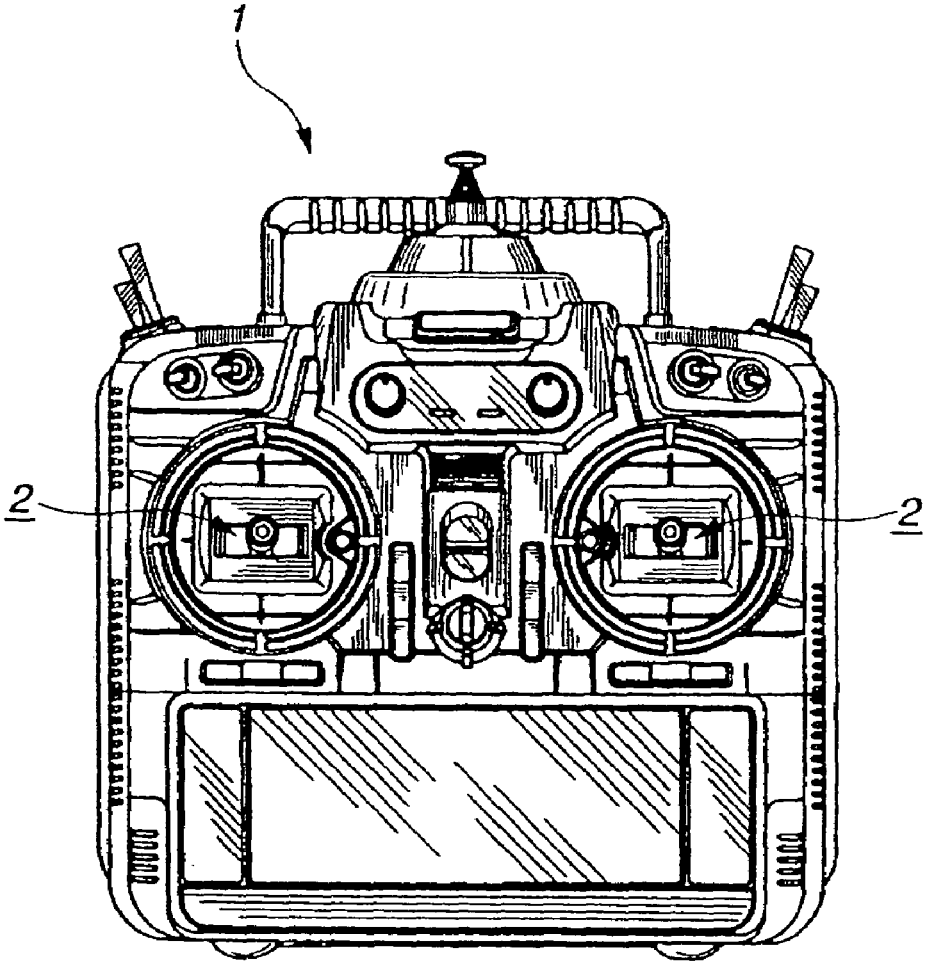
FIG.9 (PRIOR ART)
FIG. 9 is a front view illustrating a conventional radio-controlled device.

As shown in FIGS. 6 to 8, a stick lever unit 2 according to the present invention is built in the radio-controlled device 10 of the present invention. In the back surface of the housing 10*a* forming the outline of the radio-controlled device 10, the adjustment hole lob, 10*c*, through which the adjustment screw 32 is directly operated from the outside of the radio-controlled device 10 with a screwdriver or wrench, is formed at the position which opposes horizontally with the adjustment screw 32 in the stick lever unit 2.

As a result, the adjustment screw 32 is directly operated with a screwdriver or wrench inserted from the adjustment hole 10*b*, 10*c* and the resilient plate (pressure member) for acting as a stick lever holding mechanism can be suitably selected. Therefore, the user can easily change the resilient plate in the stick lever unit, without opening the housing of the radio-controlled device.

The adjustment hole 10*b*, 10*c* is plugged with a rubber or resin cover member, except during the time of adjustment. Thus, the cover member prevents dust or moisture from invading the radio-controlled device through the adjustment holes 10*b* and 10*c*. FIG. 7 shows the adjustment hole 10*b* filled with the cover member. In the adjustment hole 10*c*, the cover member is removed and the adjustment screw can be seen.

As shown in FIG. 8, the adjustment hole 10*b* is in a rectangular shape. The extended portion 10*d* extended out by one step on the inner surface of the housing 10*a* is formed on the fringe of the adjustment hole 10*b*. (This is applicable to the adjustment hole 10*c* (not shown)).

As a result, when the resilient plate acting as a pressure member forming a stick lever holding mechanism is selected or when the adjustment screw 32 is adjusted to change the pressure force in action, the adjustment screw 32 may be loosened excessively to separate the resilient plate from the column 21*c* over a limited distance. In such a case, the head of the adjustment screw 32 strikes the extended portion and stops its further travel. Thus, an excessively loosened adjustment screw 32 is prevented from falling off through the screw hole 21*d*.

The stick lever unit and the radio-controlled device equipped with the same according to the present invention, have been described by way of the illustrated embodiments. However, the present invention should not be limited only to the above embodiments. Various constituent elements can be replaced with equivalent elements having the same functions. Moreover, arbitrary configurations may be added to the present invention.

In the above-mentioned embodiments, both the resilient plate functioning when a model airplane is controlled and the resilient plate functioning when a model helicopter is controlled are integrally constructed as pressure members each constituting a stick lever holding mechanism in a stick lever unit. However, the present invention should not be limited only to that example, but the resilient plates may be formed separately. Separate resilient plates can be disposed in parallel to the fixing members in the manner similar to the embodiments, so that the same effect can be obtained to the problems, which are overcome to achieve the object of the present invention.

In the above-mentioned embodiments, as to the arc-shaped groove which is in contact with and is pressed by the pressure member forming a stick lever holding mechanism in a stick lever unit, the arc-shaped groove, which is in contact with and is pressed by the resilient plate for a model airplane and the resilient plate for a model helicopter, is formed in common to the fixing member. However, the present invention should not be limited only to the embodiments disclosed herein. The arc-shaped grooves pressed by both the resilient plates may be formed respectively in the fixing member. This allows the stick lever holding mechanism suitable for aircraft of two types to be built.

The invention has been described in connection with what are presently considered to be the most practical and preferred embodiments. However, the present invention has been presented by way of illustration and is not intended to be limited to the disclosed embodiments. Accordingly, those skilled in the art will realize that the invention is intended to encompass all modifications and alternative arrangement included within the spirit and scope of the invention as set forth by the appended claims.

We claim:

1. A stick lever unit for a radio-controlled device, comprising:

a fixing member to which a variable resistor is attached;

a rotational member, equipped with a stick lever, connected to a rotational portion of said variable resistor and rotationally journaled to said fixing member, said rotational member having an outer circumference, which has an arc-like groove in which gear-like grooves are formed;

a pressure member, bridged to said fixing member, for holding said rotational member at an arbitrary rotational position, when said arc-like groove is pressed with the resilient force of said pressure member; and an adjustment member for positioning and fixing said pressure member to said fixing member and for adjusting a distance of said pressure member spaced to said fixing member;

said pressure member having at least two types of resilient plates for applying the resilient force of said pressure member, wherein at least one of said resilient plates is selected by means of said adjustment member for applying the resilient force.

2. The stick lever unit as defined in claim 1, wherein said resilient plates have one ends coupled to said fixing member and the other ends fixed respectively to said fixing member via said adjustment member.

3. The stick lever unit as defined in claim 2, wherein each of said resilient plates is positioned to said fixing member by means of said adjustment member via a buffer.

4. The stick lever unit as defined in claim 1, wherein each of said resilient plates is positioned to said fixing member by means of said adjustment member via a buffer.

5. A radio-controlled device equipped with the stick lever unit for radio control, said stick lever comprising:

a fixing member to which a variable resistor is attached;

a rotational member, equipped with a stick lever, connected to a rotational portion of said variable resistor and rotationally journaled to said fixing member, said rotational member having an outer circumference, which has an arc-like groove in which gear-like grooves are formed;

a pressure member, bridged to said fixing member, for holding said rotational member at an arbitrary rotational position, when said arc-like groove is pressed with the resilient force of said pressure member; and an adjustment member for positioning and fixing said pressure member to said fixing member and for adjusting a distance of said pressure member spaced to said fixing member;

said pressure member having at least two types of resilient plates for applying the resilient force of said pressure member, wherein at least one of said resilient plates is selected by means of said adjustment member for applying the resilient force.

6. The radio-controlled device as defined in claim 5, wherein an adjustment opening for adjusting said adjustment member at a position opposed horizontally to said adjustment member is provided in a back surface of a housing defining the outline of said radio control device.

7. The radio-controlled device as defined in claim 6, wherein said adjustment opening has an outer circumference extending a predetermined length toward the inside of said housing.

8. The radio-controlled device defined in claim 5, wherein said resilient plates have one ends coupled to said fixing member and the other ends fixed respectively to said fixing member via said adjustment member.

9. The radio-controlled device defined in claim 5, wherein each of said resilient plates is positioned to said fixing member by means of said adjustment member via a buffer.

* * * * *

UNITED STATES PATENT AND TRADEMARK OFFICE

CERTIFICATE OF CORRECTION

PATENT NO. : 7,250,844 B2
APPLICATION NO. : 11/238594
DATED : July 31, 2007
INVENTOR(S) : Arai et al.

It is certified that error appears in the above-identified patent and that said Letters Patent is hereby corrected as shown below:

Column 2, Line 58 insert period --.-- at end of sentence after "62-87697)."

Column 6, Line 51, "hole lob." should be changed to -- hole 10b --
(should read "adjustment hole 10b, 10c,…")

Signed and Sealed this

Thirteenth Day of November, 2007

JON W. DUDAS
*Director of the United States Patent and Trademark Office*